US005099931A

United States Patent [19]

Krueger et al.

[11] Patent Number: 5,099,931

[45] Date of Patent: Mar. 31, 1992

[54] METHOD AND APPARATUS FOR OPTIONAL STRAIGHT HOLE DRILLING OR DIRECTIONAL DRILLING IN EARTH FORMATIONS

[75] Inventors: Volker Krueger, Celle; Johannes Witte, Braunschweig; Rainer Juergens, Celle, all of Fed. Rep. of Germany

[73] Assignee: Eastman Christensen Company, Salt Lake City, Utah

[21] Appl. No.: 664,496

[22] Filed: Mar. 5, 1991

Related U.S. Application Data

[63] Continuation of Ser. No. 565,185, Aug. 8, 1990, abandoned, which is a continuation of Ser. No. 305,179, Feb. 2, 1989, abandoned.

[30] Foreign Application Priority Data

Feb. 2, 1988 [DE] Fed. Rep. of Germany ..... 3804493

[51] Int. Cl.[5] ..... E21B 7/08; E21B 4/02

[52] U.S. Cl. ..... 175/75; 175/61; 175/76; 175/325.2; 175/107

[58] Field of Search ..... 175/61, 73–76, 175/325, 101

[56] References Cited

U.S. PATENT DOCUMENTS

| | | | |
|---|---|---|---|
| 3,561,549 | 2/1971 | Garrison etal. | 176/76 |
| 3,563,323 | 2/1971 | Edgecombe | 175/76 |
| 4,067,404 | 1/1978 | Crase | 175/75 |
| 4,185,704 | 1/1980 | Nixon, Jr. | 175/76 |
| 4,465,147 | 8/1984 | Feenstra et al. | 175/73 |
| 4,485,879 | 12/1984 | Kamp et al. | 175/61 |
| 4,492,276 | 1/1985 | Kamp | 175/61 |
| 4,523,652 | 6/1985 | Schuh | 175/61 |
| 4,610,307 | 9/1986 | Jurgens et al. | 175/320 |
| 4,667,751 | 5/1987 | Geczy et al. | 175/76 |
| 4,697,651 | 10/1987 | Dellinger | 175/76 |
| 4,715,452 | 12/1987 | Sheppard | 175/61 |
| 4,739,842 | 4/1988 | Kruger et al. | 175/76 |
| 4,817,740 | 4/1989 | Beimgraben | 175/76 |
| 4,877,092 | 10/1989 | Helm et al. | 175/325 |
| 4,880,066 | 11/1989 | Steiginga et al. | 175/75 |
| 4,932,482 | 6/1990 | DeLucia | 175/75 |

*Primary Examiner*—Stephen J. Novosad
*Attorney, Agent, or Firm*—Trask, Britt & Rossa

[57] ABSTRACT

The present invention relates to a method and apparatus for navigational driling in earth formations, the apparatus including a downhole drilling assembly having a drill bit driven by a downhole motor and a deflection element or elements in the assembly for imparting an angle of deflection to the drill bit relative to the drill string above the drilling assembly. At least two stabilization points for the drilling assembly in the borehole are used, with the drill bit, to define an arcuate path for the drilling assembly when the downhole motor is operating but the drill string is not rotating. When the drill string is rotated, the drilling assembly drills a substantially straight or linear borehole.

10 Claims, 4 Drawing Sheets

METHOD AND APPARATUS FOR OPTIONAL STRAIGHT HOLE DRILLING OR DIRECTIONAL DRILLING IN EARTH FORMATIONS

This application is a continuation of application Ser. No. 07/565,185, filed Aug. 8, 1990, now abandoned, which is a continuation of application Ser. No. 07/305,179, filed Feb. 2, 1989, abandoned.

BACKGROUND OF THE INVENTION

The present invention provides a method and apparatus for drilling a borehole with an optionally rectilinear or arcuate center line into earth formations.

Tools of this type, which are used for navigational drilling without tool change, are known to be available in various designs.

In order to create an angle of deflection—which at the same time determines the build-up rate to be achieved—for the rotation axis of the drill bit shaft during directional drilling, the first and the second stabilizer of a first well-known tool (U.S. Pat. No. 4,465,147) are arranged eccentrically on the casing--which has the shape of a straight tube--of the rotary drilling tool. In directional drilling operations, such a design imparts a deflection, which determines the angle of deflection, to the casing.

In a second well-known tool (U.S. Pat. No. 4,739,842), the stabilizers are concentrically arranged on the casing of the rotary drilling tool, and the casing is provided with sections deflected relative to the principal axis of the tool, which define two bends which face in opposite directions and which in combination with each other determine the angle of deflection. According to a further development of this tool, as also disclosed in the aforementioned U.S. Pat. No. 4,739,842, the deflection of the casing regions can be designed in such a way that only one single bend between the two stabilizers determines the angle of deflection.

Instead of one or two bends in the region of the casing between the first and the second stabilizer, a third well-known tool of the type mentioned in the introduction provides for a bend between the rotary drilling bit and the first stabilizer (U.S. Pat. No. 4,492,276). This bend is formed in such a way that the bit shaft is carried in the lower area of the casing--which has the form of a straight tube--at an angle relative to the axis of this casing and exits at a slant from the end of the casing.

In a fourth well-known tool (U.S. Pat. No. 4,485,879), the bit shaft is carried in the casing of the rotary drilling tool, with its rotation axis being laterally and parallelly offset with respect to the axis of the casing.

The present invention provides a method and apparatus which has a higher accuracy of tracking and a higher penetration rate during directional drilling while at the same time reducing its wear.

SUMMARY OF THE INVENTION

Methods and apparatus in accordance with the present invention utilize a downhole drilling tool which includes a drill bit, a downhole motor, a deflection member imparting an angle of deflection of the drill bit relative to the axis of the drill string above the drilling tool assembly, and at least first and second stabilization points, which may or may not be of a dimension greater than the remainder of the drilling tool. When the drilling tool is to be utilized for generally straight ("rectilinear") hole drilling, the entire drill string will be rotated to affect the drilling. When arcuate (or "navigational") drilling is desired, the drill string will be fixed in a position such that the deflection member orients the bit in the desired direction of travel, and rotation of the bit (and thus drilling) will be accomplished through use of the downhole motor. With methods and apparatus in accordance with the present invention, the axis of the bit shaft will be oriented generally tangentially (for example, 90–91°), to the radius of the arc of the intended borehole path. Particular preferred embodiments of the invention may utilize one or more bends to achieve the above relation of the bit axis to the radius of the arcuate borehole path.

With use of an apparatus according to this invention, the resulting component forces exerted on the guiding direction of the rotary drilling bit are considerably reduced during directional drilling as a result of the special orientation of the axis of the bit shaft of the rotary drilling bit, which is responsible for a more wear-resistant operation and a higher penetration rate. This applies particularly to a design of the rotary drilling tool for a build-up rate of 2°/30 inches and more. At the same time, a much greater tracking accuracy for the rotary drilling bit is achieved during directional drilling not only in uniform rock formations but also in successively different rock formations.

DETAILED DESCRIPTION OF PREFERRED EMBODIMENTS

Figure 1:
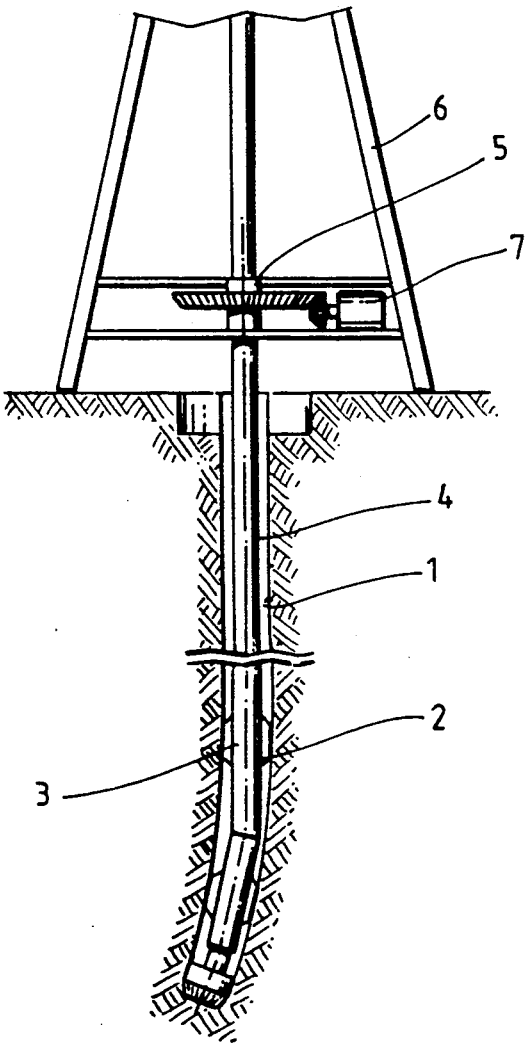
FIG. 1 depicts a truncated schematic view, partially in vertical section, of a tool for optional straight hole drilling and directional drilling with a rotary drilling tool according to this invention during directional drilling operations.

The tool shown as a schematic diagram in FIG. 1 consists of a rotary drilling tool 2 which is located in a borehole 1 and whose casing 3 is connected at its upper end to drill string 4. Drill string 4 is clamped into a rotary table 5 of a drilling rig 6. Rotary table 5 is fitted with a driving and blocking device 7 by means of which the chuck of rotary table 5, and thus of drill string 4, can be put into continuous rotation or can be aligned by means of a limited rotary movement and subsequently be secured into position so as to not be able to turn.

The embodiment of a rotary drilling tool 2 illustrated in FIGS. 1 to 4 has a casing or housing 3 which consists of several components or sections 8, 9, 10, 11, 12 which are screw-jointed to each other. Along one section of its length, casing section 10 is designed as a stator 13 of a deep-hole motor with rotor 14. In the practical example shown in FIGS. 3 and 4, deep-hole motor 13, 14 is a displacement motor operating according to the Moineau principle; however, it may also be a turbine or a motor of any suitable construction.

Rotor 14 is connected to the upper end of a bit shaft 16 by means of a propeller shaft 15 which is located in casing section 11. This bit shaft 16 rotates in bearings 17, 18 of casing section 12 which forms a bearing block. In the embodiment of the rotary drilling tool according to FIGS. 1 to 4, the bit shaft has a rotation axis 19 which is at a small angle relative to the surrounding casing axis 20 of casing section 12. In correspondence with this slanted bearing, bit shaft 16 whose outer end is fitted with a rotary drilling bit 21 exits at a slant from the lower end of casing 3.

In its lower section, near rotary drilling bit 21, rotary drilling tool 2 is fitted with a first stabilization point 22 in the form of a stabilizer 24 which is attached to casing section 12 and which has a number of stabilizer blades or ribs that are distributed throughout its circumference. At a certain distance from and above this first stabilization point 22, rotary drilling tool 2 has a second stabilization point 25 which is also formed by a conventional stabilizer 24 which is located on casing section 8. The imaginary central points of these stabilization points 22, 25, in combination with an imaginary central point of the rotary drilling bit 19*a*, define the course of an imaginary center line for borehole 1, which in the areas of borehole 1 drilled in the course of directional drilling takes an arcuate course.

The center line (not shown in the drawing for reasons of clarity) of the area of borehole 1, which in FIGS. 2 and 5 to 11 is shown to be curvilinear, has its base at point 26 and has an arc center which is substantially removed in distance.

The distance of the arc center from the arcuate center line of an area of borehole 1 produced by means of directional drilling is measured on the basis of the build-up rate ($BUR = 2\alpha/D$ in °/meter) for which the rotary drilling tool is designed. $\alpha$ denotes the angle—opening up into the direction of rotary drilling bit 21—between the imaginary connecting line of the central point 19*a* (which coincides with base 26) of rotary drilling bit 21 with the imaginary central point of the borehole at the level of the first stabilization point 22 and an imaginary lower extension of the rectilinear connecting line of the imaginary central points of borehole 1 at the level of the first and the second stabilization 22, 25. D denotes the distance between the imaginary central point of the second stabilization point 25 and the mentioned central point 19*a* of rotary drilling bit 21. The build-up rate is preferably a minimum of approximately 2°|30 meters, corresponding to a distance from the arc center to the center line of the borehole of approximately 850 meters.

As all other modifications of this invention, illustrated or imaginable, rotary drilling tool 2 is designed in such a way that in directional drilling operations, rotation axis 19 of bit shaft 16 has an orientation relative to an imaginary rectilinear connecting line 28 between the arc center and base 26 of the arcuate center line of borehole 1—which can be drilled with the rotary drilling tool—with a clearance angle $\beta$ of approximately 90° as a lower limit. The "clearance angle" is the angle between the bit axis and the radius of the curve to be drilled at the position of the bit in the borehole. Thus, in effect, angle $\beta$ of 90° represents the bit axis being tangential to the arcuate path of the borehole.

Thus, this type of orientation establishes the rotational axis 19 of bit shaft 16 as a tangent to the arcuate center line of borehole 1 at the level of base 26, with the result that the resulting component forces exerted upon rotary drilling bit 21 are reduced to a minimum. In the conventionally known tools discussed earlier herein, these component forces are considerably greater since in these tools, the rotation axis 19 of bit shaft 16 forms a secant to the arcuate center line of a borehole drilled by means of directional drilling, with intersections with the center line, which are located above base 26.

Clearance angle 8 may also be slightly larger than 90°, and thus may range between approximately 90° and 91°. This "lead" makes it possible to compensate for bending strains which a rotary drilling tool may be subjected to as it is introduced into a partially drilled borehole, e.g., in the course of a round trip.

Between the first and the second stabilization points 22, 25, rotary drilling tool 2 has a bend 29, and in the area between rotary drilling bit 21 and the first stabilization point 22, there is a second bend 30. Preferably, both bends 29, 30 (in the principal axis defined by several individual sections connected to each other) are located in the integral casing section 12, in which the lower stabilization point 22 is to be found, and both bends 29, 30 face into the same direction, namely toward the arc center.

In rotary drilling tool 2, bend 29 is formed by a cocked upper threaded pipe connection 31 of casing section 12, and the second bend 30 is formed by the inclined bearing 17, 18 of bit shaft 16 in casing section 12. The sum of the values of both angles of bend corresponds to the value of the angle of deflection $\alpha$, and the build-up rate is calculated on the basis of the angles of bend. In the presence of several bends, it is, however, possible to assign different values to the angles, thus making it possible to take special structural arrangements into consideration. Preferably, it is bend 29 which is used to determine the build-up rate while bend 30 is mainly responsible for the desired clearance angle $\beta$. Thus, for example, the angle of bend of bend 29 may measure 1.5° and more, while the angle of bend of bend 30 may, for example, amount to 0.6° or less.

The location of both bends within one single casing section 12, as suggested for rotary drilling tool 2, simplifies the structural design since all other casing sections 8 to 11 located higher up can consist of straight-line pipes.

Figure 5:
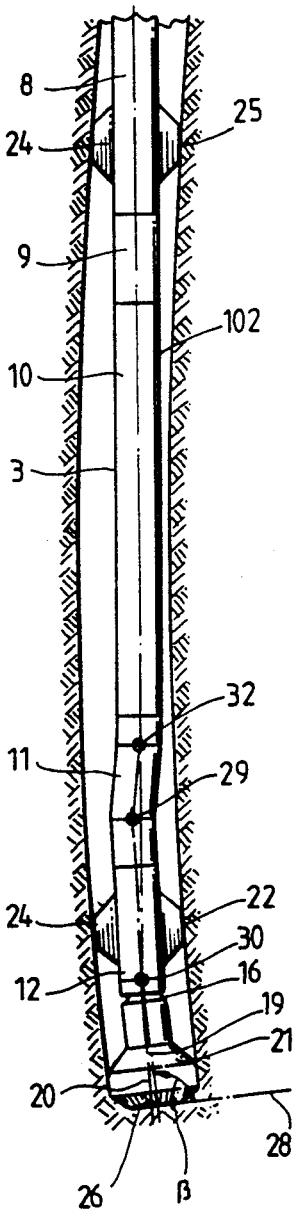
FIGS. 5 to 11 are schematic representations similar to those shown in FIG. 2 to further illustrate seven alternative embodiments of a rotary drilling tool in accordance with the present invention.

FIG. 5 illustrates an alternative embodiment of a rotary drilling tool 102 in which, in addition to bend 29, a further bend 32 is provided between the first stabilization point 22 and the second stabilization point 25. Both bends 29, 30 may face into the same direction of bend or may, as shown in FIG. 5, face in opposite directions, with bend 32 facing away from the arc center of the arcuate center line of borehole 1 and with bend 29 having a direction of bend facing this borehole center. This type of arrangement of the directions of bend reduces and eliminates an eccentricity of the imaginary center point of rotary drilling bit 21 relative to an imaginary rectilinear lower extension of the upper section 27 of the principal axis of the tool. Furthermore, this type of arrangement of the directions of bend is to be preferred for drilling operations in which rotary drilling bits 21 with a small diameter and a low clearance are used.

Figure 4:
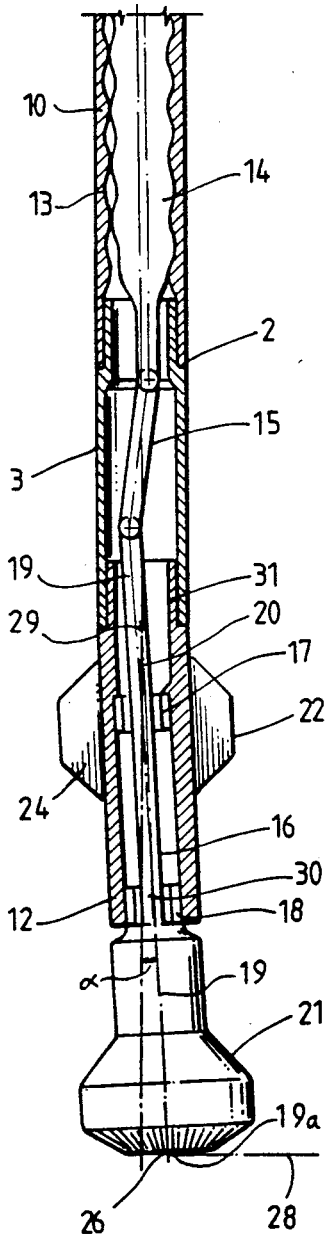
FIG. 4 depicts a schematic cross-sectional view of the lower portion of the rotary drilling tool according to FIG. 2, with this lower portion being a continuation of the corresponding upper portion of the representation according to FIG. 3.

Otherwise, the embodiment of the tool according to FIG. 5 corresponds largely to that according to FIG. 4; therefore, corresponding reference numbers are used customarily for corresponding structural components. Both bends 29, 32 are located within one casing section 11 which may be molded in the form of one integral section, or casing section 11 may consist of three separated sections with cocked threaded pipe connections.

Figure 2:
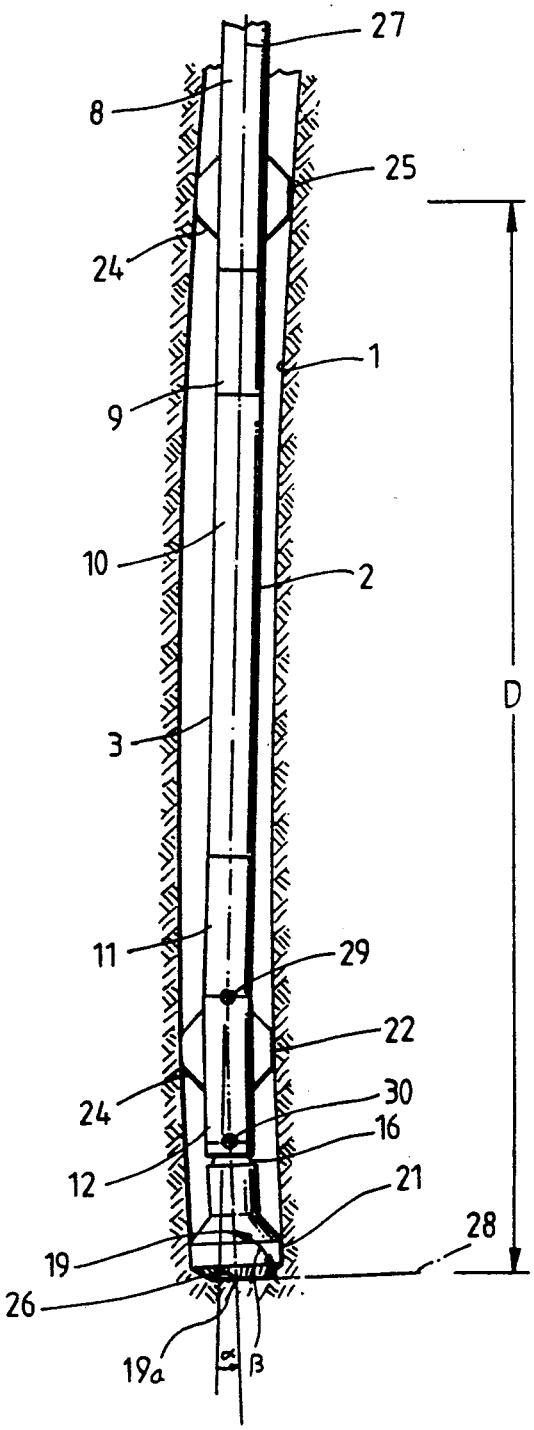
FIG. 2 depicts a schematic representation of a first embodiment of a rotary drilling tool in accordance with the present invention in a drilling hole produced by means of directional drilling and having an arcuate center line.
Figure 3:
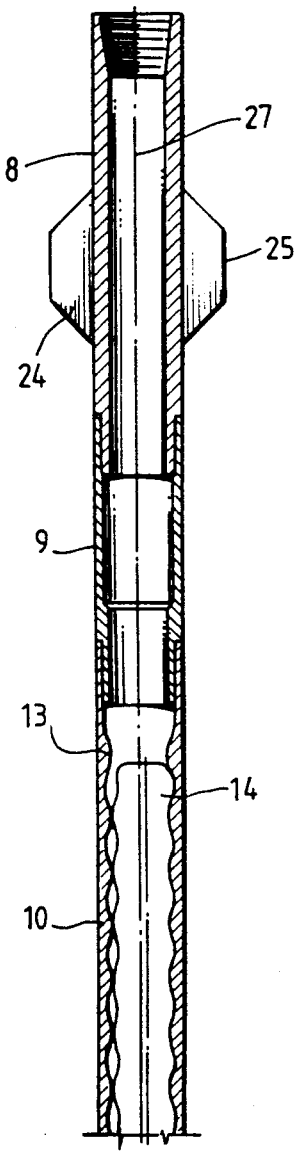
FIG. 3 depicts a schematic cross-sectional view of the upper portion of the rotary drilling tool according to FIG. 2.
Figure 6:
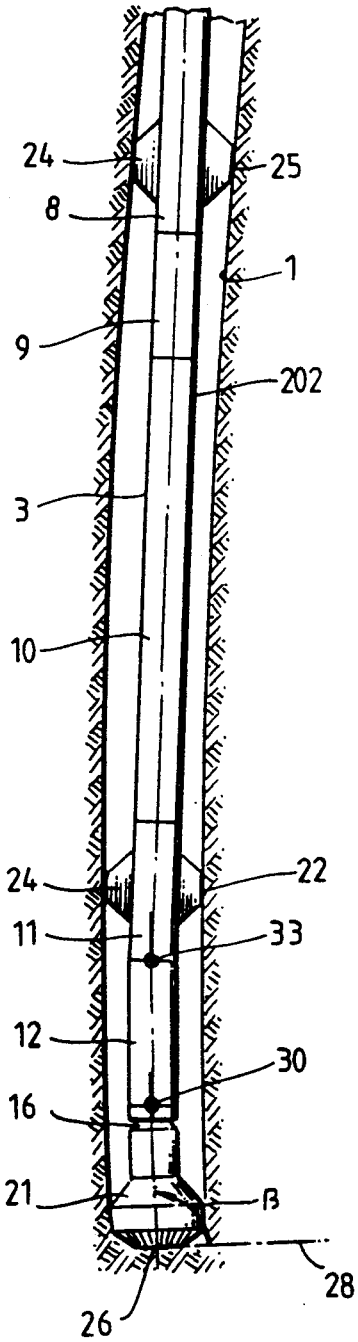

FIG. 6 illustrates another embodiment of a rotary drilling tool 202 which differs from rotary drilling tool 2 in that instead of bend 29, it has a different bend 33 which is located between the rotary drilling bit 21 and the first stabilization point 22. Like bend 30, this other bend 33 may be structurally designed identically to bends 29, 30 (FIG. 2). Again, both bends 30, 33 are located within casing section 12; however, the first stabilization point 22 is to be found in casing section 11.

Figure 7:
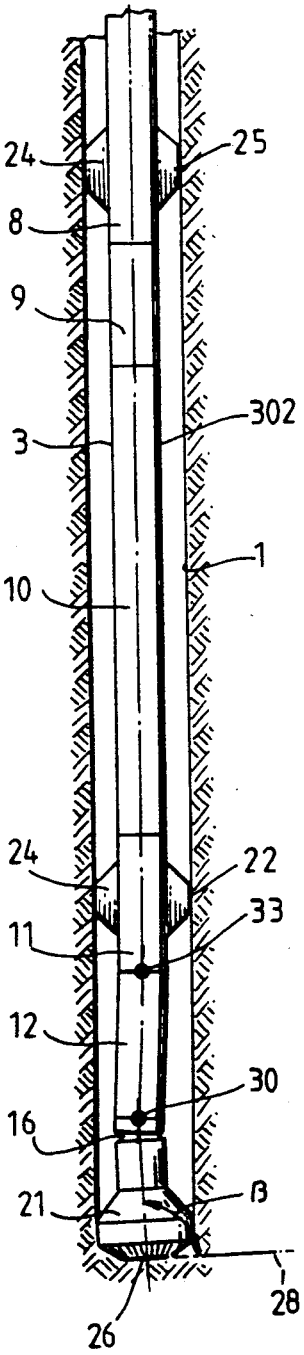

FIG. 7 illustrates another alternative embodiment of a rotary drilling tool 302 which is essentially the same as that shown in FIG. 6, with the exception that bend 33 faces into a direction of bend opposite to that of bend 30. Bend 33 has a direction of bend facing away from the arc center, and the lower bend 30 has a direction of bend facing the arc center.

Figure 8:
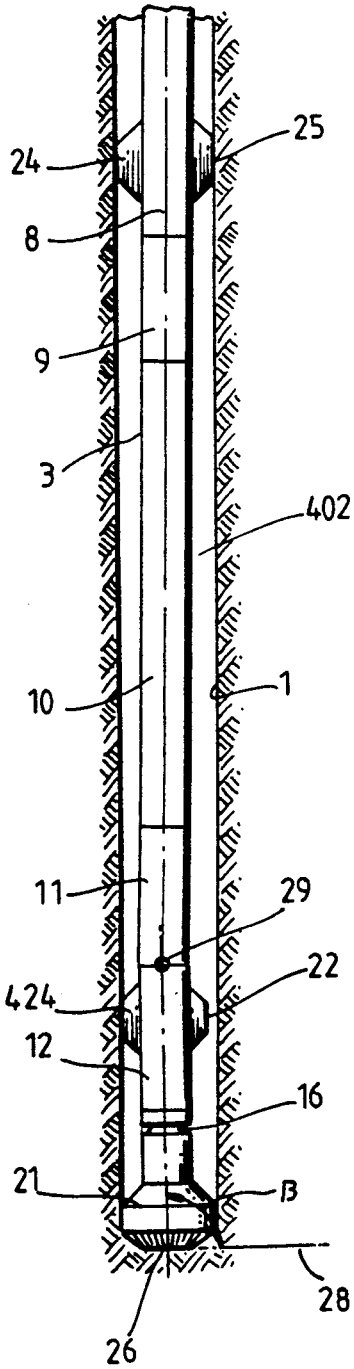

FIG. 8 shows an embodiment of a rotary drilling tool 402 which has only one bend 29, which corresponds to bend 29 of rotary drilling tool 2, between stabilization points 22, 25. As an additional measure, the lower stabilization point 22 is formed by stabilizer 424 which is undersized compared to a stabilizer which, relative to a given rotary drilling bit 21, is designed in standard size. Furthermore, rotary drilling tool 402 as shown in the embodiment of FIG. 8 is fitted with a bit shaft 16 which is seated coaxially in casing section 12.

Figure 9:
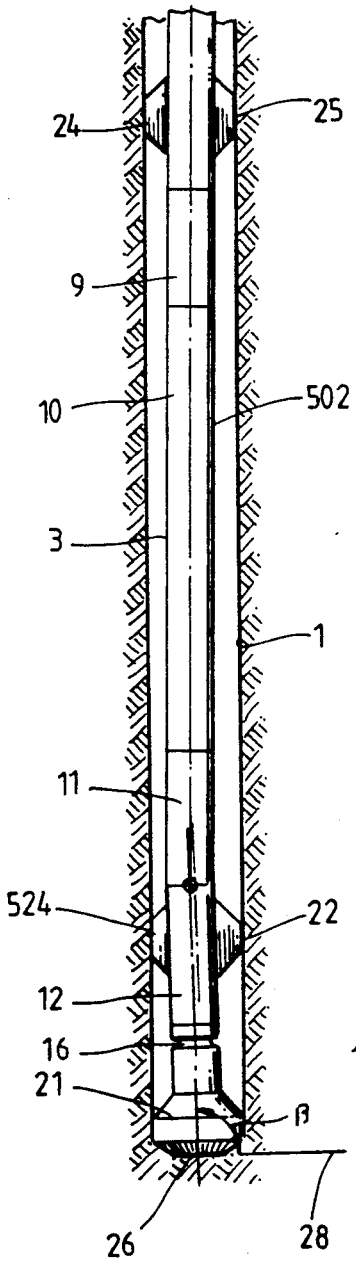

Another alternative embodiment of rotary drilling tool 502 is depicted in FIG. 9 and is similar to that shown in FIG. 8, with the difference that the lower stabilization point 22 is formed by stabilizer 524 which is eccentrically arranged on casing section 12.

Figure 10:
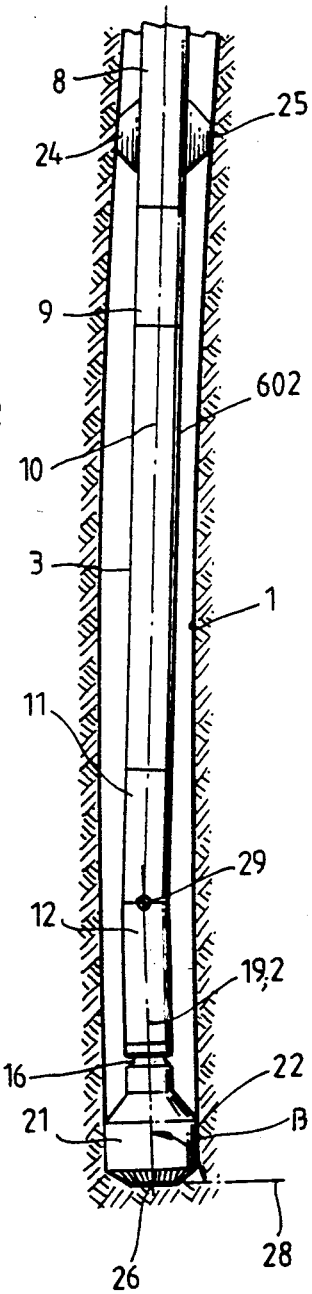

Yet another alternative embodiment of rotary drilling tool 602 is illustrated in FIG. 10. Rotary drilling tool 602 is designed in such a way that the first stabilization point 22 is located on rotary drilling bit 21 and forms an integral part thereof, e.g., by inserting a stabilization component after the cutting element and molding it to the bit. Otherwise, rotary drilling tool 602 has one single bend 29 between the two stabilization points 22, 25; this single bend 29 may correspond in its construction to bend 29 as shown in FIG. 4.

Figure 11:
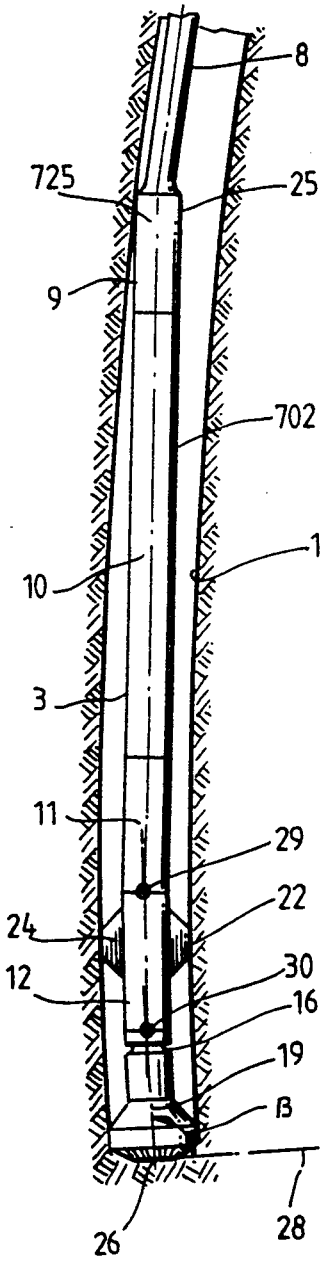

FIG. 11 finally shows another alternative embodiment of a rotary drilling bit 702 in which the upper stabilization point 25 is not formed by a stabilizer of conventional form or shape but by a stabilization region of casing 3 or its casing section 8. At the same time, this stabilizer is undersized compared to the standard stabilizer. In a borderline case, as illustrated, the diameter of this stabilizer may correspond to the diameter of casing 3. As is the case for rotary drilling tool 2 according to FIG. 2, rotary drilling tool 702 has a bend 29 in the region between stabilization points 22, 25 and a bend between rotary drilling bit 21 and the first stabilization point 22 whose structural form may be identical to that of rotary drilling tool 4.

Instead of bends which define a predetermined angle of bend, such as is the case if bit shaft 16 is carried in slanted bearing 17, 18 or if the threaded pipe connections 31 are cocked, it is also possible to provide bends which are formed only in the course of the directional drilling operation. These bends form under stress in special casing sections to which the formation of the bends is restricted due to the fact that these particular sections are provided with a special flexibility.

What is claimed is:

1. An apparatus for drilling a subterranean borehole with an optionally straight or curved center line, comprising:

a rotary drilling tool including a housing and having a drill string secured to the top thereof;

means for rotating said rotary drilling tool by said rill string for straight hole drilling and for rotationally orienting and maintaining said rotary drilling tool free from rotation for curved hole drilling;

a motor in said rotary drilling tool having a rotatable drive shaft extending therefrom on which a rotary drill bit is mounted;

a first stabilization point for said rotary drilling tool proximate said rotary drill bit;

a second stabilization point for said rotary drilling tool located a fixed distance above said first stabilization point;

a first bend in said rotary drilling tool between said rotary drill bit and said first stabilization point; and a second bend in aid rotary drilling tool between said first stabilization point and said second stabilization point.

2. An apparatus in accordance with claim 1, wherein said first bend is formed by a slanted bearing supporting said drive shaft, and said second bend is formed by a cocked threaded pipe connection in said rotary drilling tool housing.

3. An apparatus in accordance with claim 1, wherein the direction of bend of said second bend located between the first and the second stabilization point aid said first bend located between the first stabilization point and the rotary drill bit are the same.

4. An apparatus in accordance with claim 1, wherein the directions of bend of said second bend located between the first and the second stabilization point and said first bend located between the first stabilization point and the rotary drill bit face are in opposite directions.

5. An apparatus in accordance with claim 4, wherein said second bend faces away from the arc center of the arcuate center line of the borehole to be drilled and wherein said first bend faces into the direction of the arc center.

6. An apparatus for drilling a subterranean borehole with an optionally straight or curved center line, comprising:

a rotary drilling tool having a drill string secured to the top thereof;

means for rotating said rotary drilling tool by said drill string for straight hole drilling and for rotationally orienting and maintaining said rotary drilling tool free from rotation for curved hole drilling;

a motor in said rotary drilling tool having a rotatable drive shaft extending therefrom on which a rotary drill bit is mounted;

a first stabilization point for said rotary drilling tool proximate said rotary drill bit;

a second stabilization point for said rotary drilling tool located a fixed distance above said first stabilization point; and first and second bends in said rotary drilling tool located between said rotary drill bit and said first stabilization point.

7. An apparatus for drilling a subterranean borehole with an optionally straight or curved center line, comprising:

a rotary drilling tool having a drill string secured to the top thereof;

means for rotating said rotary drilling tool by said drill string for straight hole drilling and for rotationally orienting and maintaining said rotary drilling tool free from to rotation for curved hole drilling;

a motor in said rotary drilling tool having a rotatable drive shaft extending therefrom on which a rotary drill bit is mounted;

a first stabilization point for said rotary drilling tool proximate said rotary drill bit;

a second stabilization point for said rotary drilling tool located a fixed distance above said first stabilization point;

wherein one of said first and second stabilization points is provided by a stabilizer located on the exterior of said rotary drilling tool; and wherein the other of said first and second stabilization points is provided by a surface on said rotary drilling tool which is substantially undersized compared to said stabilizer.

8. An apparatus in accordance with claim 7, wherein said other stabilization point is formed by a surface of a dimension which corresponds to the diameter of the drilling tool.

9. An apparatus for drilling a subterranean borehole with an optionally straight or curved center line, comprising:

a rotary drilling tool having a drill string secured to the top thereof;

means for rotating said rotary drilling tool by said drill string for straight hole drilling and for rotationally orienting and maintaining said rotary drilling tool free from rotation for curved hole drilling;

a motor in said rotary drilling tool having a rotatable drive shaft extending therefrom on which a rotary drill bit is mounted;

a first stabilization point for said rotary drilling tool proximate said rotary drill bit;

a second stabilization point for said rotary drilling tool located a fixed distance above said first stabilization point; and wherein said first stabilization point is an integral part of said rotary drill bit.

10. An apparatus for drilling a subterranean borehole with an optionally straight or curved center line, comprising:

a rotary drilling tool having a drill string secured to the top thereof;

means for rotating said rotary drilling tool by said drill string for straight hole drilling and for rotationally orienting and maintaining said rotary drilling tool free from rotation for curved hole drilling;

a motor in said rotary drilling tool having a rotatable drive shaft extending therefrom on which a rotary drill bit is mounted;

a first stabilization point for said rotary drilling tool proximate said rotary drill bit;

a second stabilization point for said rotary drilling tool located a fixed distance above said first stabilization point; and wherein said rotary drilling tool defines a longitudinal axis, said drive shaft defines a longitudinal axis, and said drive shaft is disposed in said drilling tool so that said drive shaft axis is parallel to but laterally offset from said rotary drilling tool axis.

* * * * *

UNITED STATES PATENT AND TRADEMARK OFFICE

CERTIFICATE OF CORRECTION

PATENT NO. : 5,099,931

DATED : March 31, 1992

INVENTOR(S) : Krueger, et al.

It is certified that error appears in the above-identified patent and that said Letters Patent is hereby corrected as shown below:

In Column 2, line 22, "inches" should be -- meters --.

In Column 4, line 12, replace "8" with -- B --.

In Column 6, line 9, replace "rill" with -- drill --.

Signed and Sealed this

Sixth Day of July, 1993

*Attest:*

Michael K. Kirk

MICHAEL K. KIRK

*Attesting Officer*

*Acting Commissioner of Patents and Trademarks*